United States Patent [19]

Schuetz

[11] 4,103,530

[45] Aug. 1, 1978

[54] SELF-CENTERING PUNCH FOR BILLET CENTERING MACHINE OR THE LIKE

[75] Inventor: James W. Schuetz, Pittsburgh, Pa.

[73] Assignee: Aetna-Standard Engineering Company, Ellwood City, Pa.

[21] Appl. No.: 788,253

[22] Filed: Apr. 18, 1977

[51] Int. Cl.[2] ..... B21D 28/04

[52] U.S. Cl. ..... 72/312

[58] Field of Search ..... 72/296, 297, 312, 316, 72/368, 370, 482; 29/406

[56] References Cited

U.S. PATENT DOCUMENTS

| | | | |
|---|---|---|---|
| 671,430 | 4/1901 | Baker | 72/297 |
| 2,341,602 | 2/1944 | Dewey | 72/316 |
| 3,091,139 | 5/1963 | Jackson | 72/297 |

*Primary Examiner*—Michael J. Keenan

*Attorney, Agent, or Firm*—Mandeville and Schweitzer

[57] ABSTRACT

The disclosure relates to apparatus for center punching a hot metal billet preparatory to a piercing operation, in the production of seamless tubing. The apparatus provides a simple, reliable, mechanical arrangement effective to automatically compensate for normal variations in the diameter of successive hot metal billets, such that the center punching operation is carried out with greater accuracy than has heretofore been attained in regular production operations. The apparatus includes means for mechanically clamping a hot metal billet preparatory to center punching, and means for axially advancing a center punching tool into the end of the clamped billet. The center punching tool itself is mounted for limited transverse movement in relation to its advancing means, and is mechanically coupled to the clamping means by a compensating mechanism. Minor transverse adjustment of the position of the center punching tool in relation to the nominal axis of the apparatus, in order to obtain greater accuracy of alignment with the actual center line of a billet, is achieved by moving the center punching tool as a function of movement of the clamping mechanism. The clamping mechanism serves inherently to sense the actual diameter of the billet which is being clamped.

11 Claims, 9 Drawing Figures

SELF-CENTERING PUNCH FOR BILLET CENTERING MACHINE OR THE LIKE

BACKGROUND AND SUMMARY OF THE INVENTION

In the production of seamless metal tubing, cylindrical billets, heated to an appropriate temperature, are simultaneously rotated and advanced over a mandrel-mounted piercing point. The billet is thus formed into a hollow seamless tube, which is thereafter processed by other mills, in which it is elongated, reduced to desired diameter and wall thickness, and eventually cut to desired length. As will be appreciated, the accuracy, or lack of it, with which the initial piercing operation is carried out, is reflected throughout all the subsequent processing operations and in the finished tubing. Thus, the more precisely the original piercing point is aligned with the geometric axis of the billet, the more uniform will be the walls of the tubing and the higher the quality of the finished product.

In order to properly start the advancing of the billet over the piercing point, it has been conventional for many years to form a centering recess in the end of the billet, which serves to align and stabilize the piercing point as the piercing operation is commenced. In recent years, hydraulic billet centering equipment has been widely used for this purpose, in which a hot metal billet is held by a clamp, and a centering punch is hydraulically advanced against the billet to provide the desired centering indentation.

Metal billets for seamless tube production are conventionally produced by a variety of techniques, among which are continuous casting, extrusion, hot rolling, and turning. In any of these operations, there are inevitable variations from the nominal outside diameter of the billet. The overall variation in diametral dimension will, of course, be a function of individual mill practices, but even in the most efficient and quality conscious mills, variations are bound to occur in the initial production of the billets. Additionally, prior to center punching, the billets are heated to piercing temperature, typically around 1150° C. This of course results in an increase in the diameter of the billet, which may vary somewhat from billet to billet, depending on the particular alloy composition.

In accordance with the present invention, a novel and improved hydraulic billet centering machine is provided, which includes means for automatically adjusting the position of the center punching tool in relation to the actual diameter of the billet, such that the center punch is at all times accurately related to the actual geometric axis or center line of the billet. More particularly, an improved center punching apparatus is provided, which includes means for axially advancing a center punching tool, wherein the tool is mounted for limited transverse adjustment along a plane including the geometric axis of a billet clamped in the equipment. The transverse adjustment of the center punching tool is independent of its position of advancement or retraction in the direction of the billet axis and is automatically related to the actual diameter of the billet being centered.

In accordance with another specific aspect of the invention, a hydraulic billet centering machine is provided, as described in the preceding paragraph, in which the transverse adjusting mechanism for the center punching tool is mechanically connected to a billet clamping mechanism. The clamping mechanism, which is arranged to grip the billet from opposite sides and includes one fixed and one movable clamping die, is inherently responsive to the actual size of the billet, having a greater closing movement onto a smaller diameter billet than a larger diameter billet. This inherent sensing action of the clamping means is directly utilized to provide a fine adjustment of the center punch position, so that an exceptionally high degree of centering accuracy is achieved in normal mill production operations.

For a more complete understanding of the above and other features and advantages of the invention, reference should be made to the following detailed description and to the accompanying drawings.

DESCRIPTION OF A PREFERRED EMBODIMENT OF THE INVENTION

Figure 7:
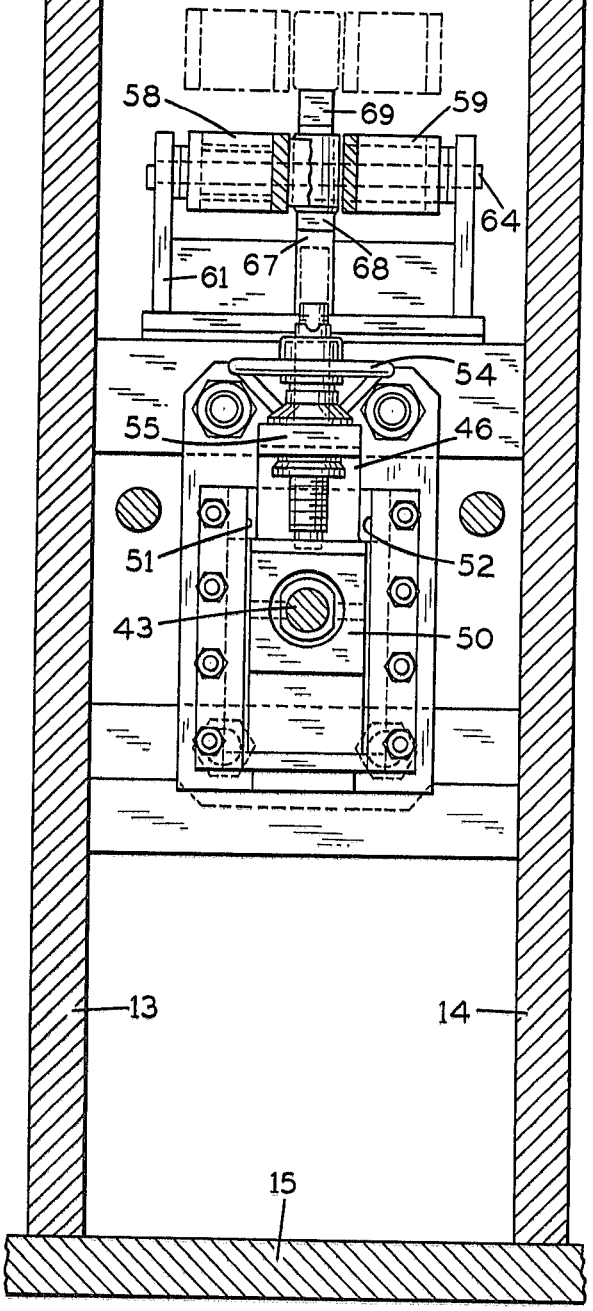
FIGS. 6 and 7 are enlarged, fragmentary cross sectional views as taken generally on lines 6—6, 7—7 respectively of FIG. 5.

Referring now to the drawings, and initially to FIGS. 1–4 thereof, the reference numeral 10 designates generally a frame structure which houses and supports the billet centering mechanism. Adjacent the front of the frame 10 is a transfer table 11, in the form of a trough, on which cylindrical billets 12 may be supported and advanced into or removed from the working position. The frame structure 10 typically may include a pair of heavy side plates 13, 14 (FIG. 7), a base plate 15, and a front plate 16.

In the front of the apparatus is a clamping mechanism, generally designated by the numeral 17, which is arranged to receive the leading end of a billet 12, advanced along the supporting trough 11 by an appropriate pushing means (not shown). The clamping mechanism includes a rigid pedestal structure 18, inluding a horizontal pedestal plate 19. The plate 19 mounts transverse guide members 20, 21 which slideably receive a lower clamping die 22, which is secured in proper alignment with the working axis of the machine, by means of a locating pin 23. The pin 23 is received in aligned openings 24, 25 provided respectively in a locating lug 26 carried by the die and a similar lug 27 associated with the pedestal plate 19.

Figure 1:
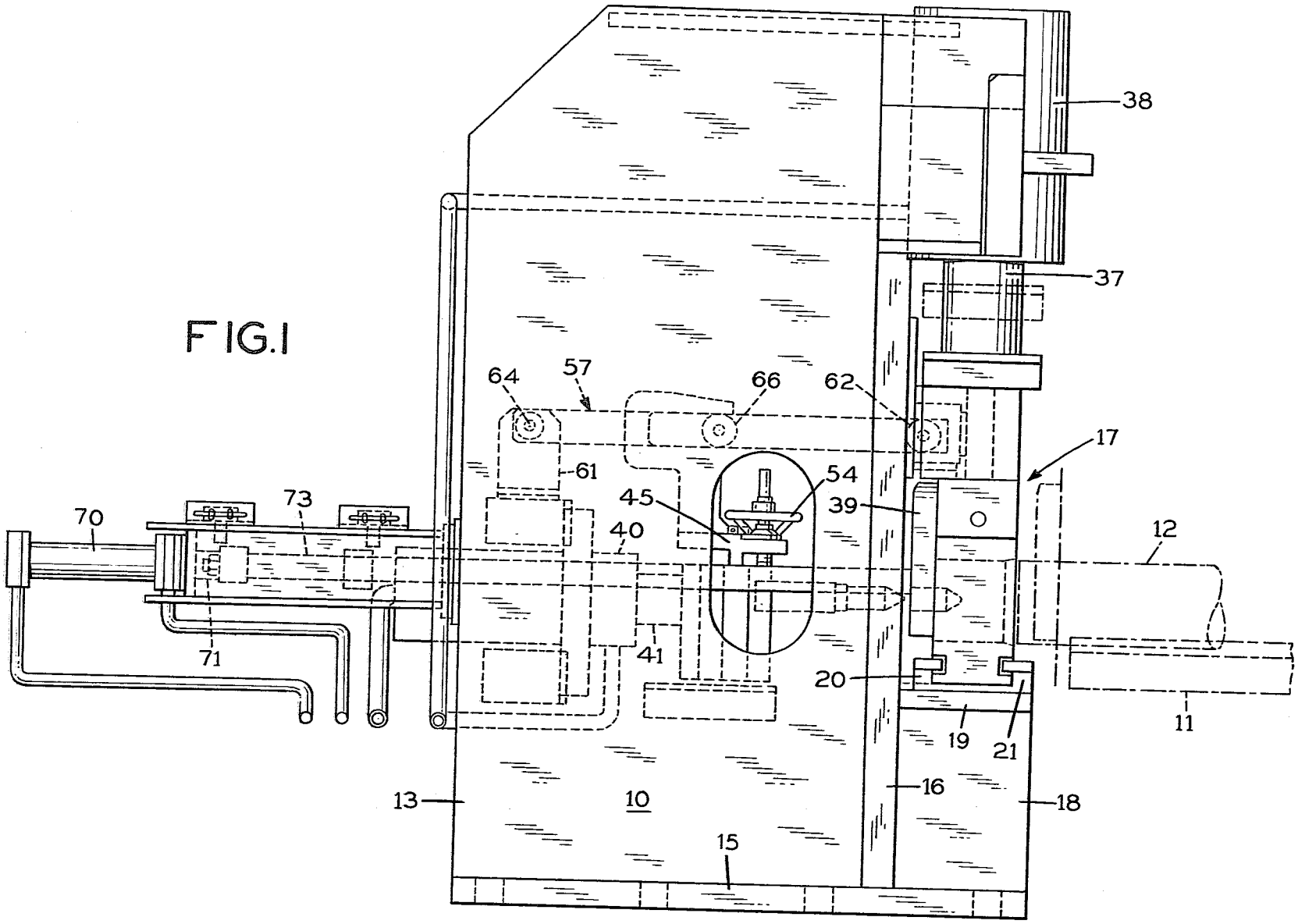
FIG. 1 is a side elevational view of a billet centering apparatus constructed in accordance with the principles of the invention.
Figure 2:
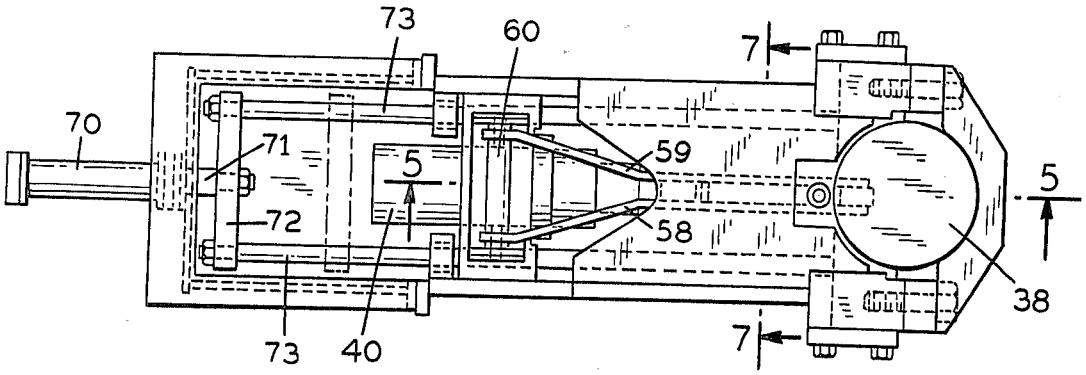
FIG. 2 is a top plan view of the apparatus of FIG. 1.
Figure 3:
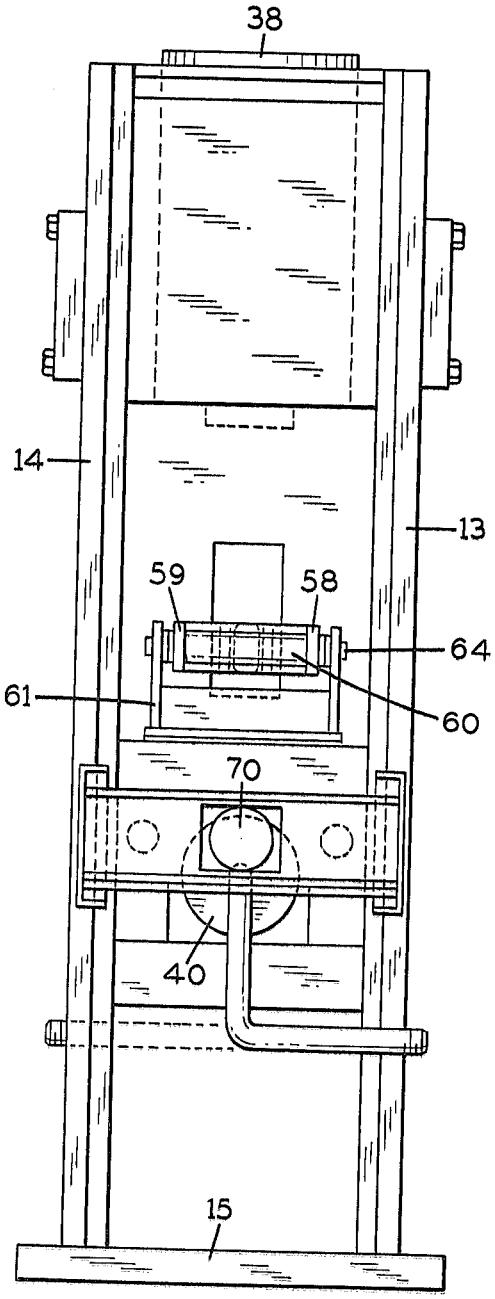
FIG. 3 is a back end elevational view of the apparatus of FIG. 1.
Figure 4:
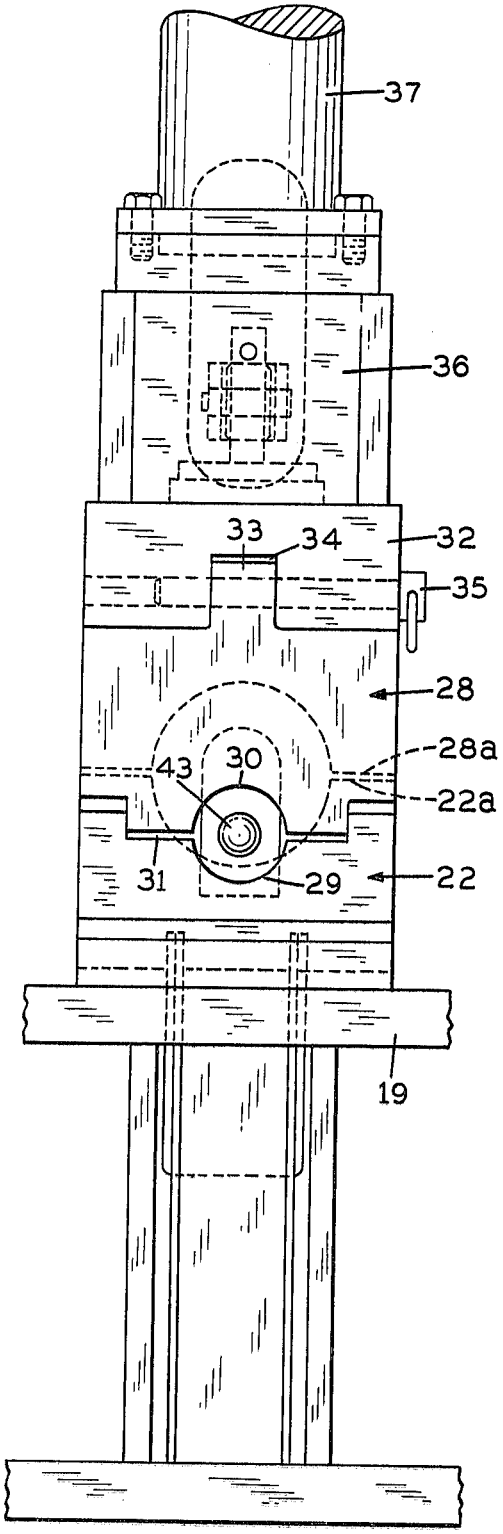
FIG. 4 is a fragmentary front elevational view of the apparatus of FIG. 1.

As reflected particularly in FIG. 4, the lower die block 22 cooperates with an upper die block 28, and both blocks are provided with substantially semi-cylindrical recesses 29, 30 for the reception and clamping of a cylindrical billet. The clamping recesses 29, 30 are constructed to be slightly less than 180° of arc, and are dimensioned to be slightly larger than a predetermined nominal diameter. When the dies are closed to the nominal diameter, sufficient clearance 31 (FIG. 4) is provided between the dies to enable further closing of the dies to engage and grip a slightly undersized billet.

As will be appreciated, a separate set of upper and lower clamping dies is provided for each nominal diameter of billet. Typically but without implying any limitation, clamping dies may be provided in approximately one inch increments, covering a range of sizes from about four inches to about nine or ten inches in diameter. A small diameter die set 22, 28 is illustrated in full lines in FIG. 4, while a large diameter die set is indicated in broken lines, identified by the numerals 22a, 28a.

In the illustrated arrangement, the upper die block 28 is secured to a die block holder 32 by means of a tang 33 projecting upwardly from the die block and received in a locating recess 34 in the die block holder. A locking pin 35 secures the parts together when they are in properly aligned relation.

In the illustrated equipment, the die block holder 32 is secured by a spacer pedestal 36 to the ram 37 of a large diameter hydraulic cylinder 38 mounted rigidly in the upper portion of the frame structure 10.

Prior to the center punching operation, a billet 12 is advanced into the open clamping dies 22, 28, until the leading end of the billet engages and is stopped by a pusher plate 39, to be described. Pressure fluid is then admitted to the upper end of the clamping cylinder 38, causing the upper clamping die to descend toward the fixed lower die 22 until the billet 12 is properly gripped. As will be understood, and as will be referred to further, the final position reached by the upper die 28, in clamping the billet, will be a function of the precise diameter of the billet. If the billet is slightly undersized, the upper clamping block will descend to a position slightly below "normal", whereas if the billet is oversized, the upper clamping block will be stopped in a position slightly above "normal". Pursuant to the invention, these slight variations in the ultimate position of the upper clamping block are utilized to correspondingly adjust the precise position of the center punch.

Mounted at the back of the frame structure 10 is a horizontally disposed hydraulic cylinder 40, having a large diameter, forwardly extendable ram 41. Rigidly secured to the forward end of the ram 41, which may be referred to hereinafter as the punching ram, is a mounting bracket 42 for a center punching tool 43.

Figure 5:
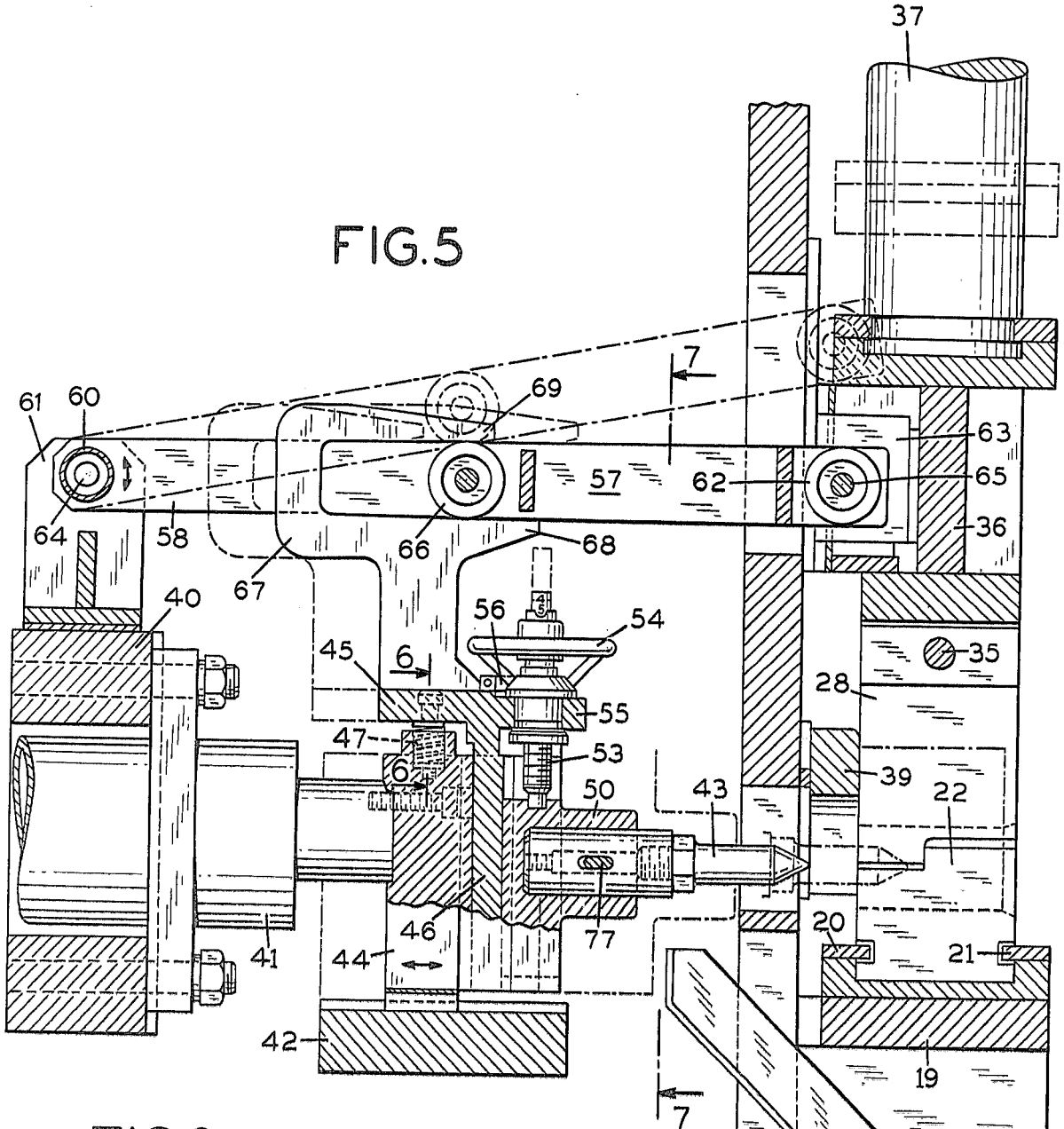
FIG. 5 is a cross sectional view as taken generally on line 5—5 of FIG. 2.

As reflected particularly in FIG. 5, the punch mounting bracket 42 includes a rigid, heavy-duty, vertically disposed base 44, which is secured directly to the ram 41 and which mounts, on its forward face, a floating slide bracket 45. The slide bracket 45 includes a vertically disposed plate 46, which is supported directly on the base block 44 and is slideably guided at its side edges by the base block 44, for limited vertical movement. Suitable dovetail or similar guide ways may be provided for this purpose.

Normally, the floating slide bracket 45 is held in a predetermined upper limit position, by means of heavy-duty compression springs 47 (FIG. 6) which are recessed in the base block 44 and act upwardly on the floating slide 45. Bolts 48 serve to limit the upward movement of the floating slide, whereas the clearance space 49 between the slide 45 and base block 44 serves to limit the amplitude of downward movement which may be accommodated. The function and operation of the floating slide bracket 45 constitutes a significant aspect of this invention and will be described in further detail.

Slideably mounted on the front of the plate 46, of the floating slide bracket 45, is a vertically slideable mounting block 50, which directly receives and secures the punching tool 43. The mounting block 50 is supported in a vertical plane directly on the front face of the slide plate 46, and is slideably engaged at its opposite side edges in dovetail slots 51, 52 or the like (FIG. 7) for guided vertical movement. The mounting block 50 is secured at its upper end to a threaded adjusting rod 53, which extends upward and is threadedly engaged with an adjusting hand wheel 54, the latter being supported and journaled in a forward extension 55 of the floating slide block. By rotating the hand wheel 54, the threaded rod 53, and the mounting block 50 and center punch 43 along with it, can be raised and lowered to predetermined positions. A pivoted keeper lug 56 prevents rotation of the hand wheel 54 after a predetermined setting has been achieved.

As is reflected in FIG. 4, the nominal working axis of the equipment (i.e., the axis of a nominal billet) is substantially lower for the smallest size of billet than for the largest size. For the intermediate sizes, the working axis lies between the two extremes illustrated in FIG. 4, with the axis progressing in an upward direction with billets of increasing size. Accordingly, as the dies 22, 28 are changed, to accommodate different sizes of billets, the hand wheel 54 is manipulated to raise or lower the punch mounting block 50 to a new position, corresponding to the nominal axis of the new set of dies. Appropriate calibrations may be provided on the hand wheel 54 and/or rod 53 to assist in this initial adjustment.

In order to compensate for normal variations from the "nominal" diameter of the billet, the floating slide block 45 is mechanically interlocked with the movable upper die block 28 in such manner that the punching tool 43 is slightly raised or slightly lowered from its nominal position by an amount corresponding to the displacement of the billet axis from its nominal position. To this end, the apparatus is provided, in accordance with the invention, with a compensating lever 57, which comprises a pair of spaced bars 58, 59. At their back ends, the bars 58, 59 are spread apart by a spacer cylinder 60, to provide increased stability, and the lever 57 is pivoted at that end to a bracket 61 mounted in fixed relation to the main machine frame 10. At its forward end extremity, the compensating lever 57 mounts a cam roll 62, which is received between the upper and lower arms of a C-shaped bracket 63 secured rigidly to the spacer pedestal 36. The arrangement is such that the cam roll 62 is mechanically confined by the bracket 63 and is thus raised or lowered along with movements of the clamping ram 37.

Midway between the pivot axis 64 of the lever and the axis 65 of the front cam roll 62 is an intermediate cam roll 66, which is mounted between the lever bars 58, 59. Cooperating with the intermediate cam roll 66 is a forwardly opening C-shaped bracket 67, which is mounted on and extends upwardly from the floating slide bracket 45. The C-shaped bracket 67 has a lower extension 68, which is arranged to underlie the cam roll 66 in all positions of the bracket, it being understood in this respect that the bracket is movable forward and rearward by the punching ram 41. Desirably, the bracket 67 is also provided with an upper extension 69, which is somewhat shorter in length than the lower extension 68, being arranged to overlie the intermediate cam roll 66 when the ram 41 is in a partially advanced condition, but being clear of the cam roll when the ram 41 is fully retracted, as reflected in broken lines at the left in FIG. 5.

In the illustrated form of the invention, the compensating lever 57 is arranged to be positioned substantially horizontally, whenever the upper clamping die 28 is in proper position to engage a billet of "nominal" size. In this respect, the graduated sets of dies are in all cases arranged such that, when the nominal billet properly engages, the upper die block will be substantially in a predetermined position, which is substantially the same for all sizes. In this predetermined position, the lever 57 is in its nominal, preferably horizontally disposed position. If the billet is slightly undersized, causing the upper die block to descend below the nominal position, the compensating lever 57 is tilted slightly downward, whereas, if the billet is slightly oversized, the compensating lever will be tilted slightly upward.

As will be understood, the center line or working axis of a given billet will be displaced from its nominal position by an amount equal to one half of the amount by which the diameter of the billet is over or under the nominal size. Accordingly, by locating the intermediate cam wheel 66 halfway between the pivot axis 64 and the axis of the forward cam roller 62, it is provided that the intermediate cam roller 66 will be displaced upward or downward from nominal position by exactly half the displacement of the upper die block 28.

Figure 6:
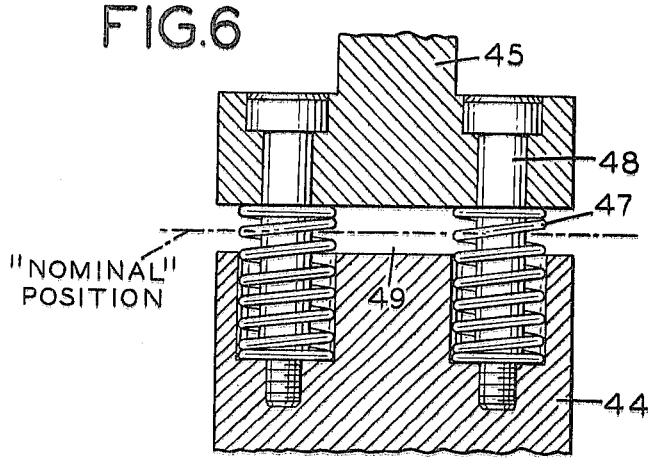
Figure 6:
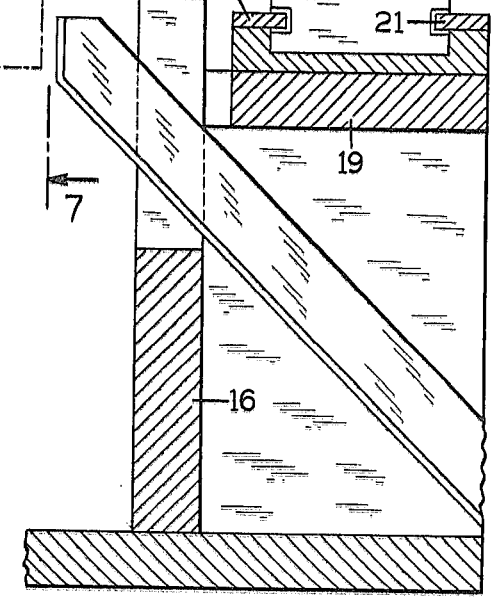
Figure 9:
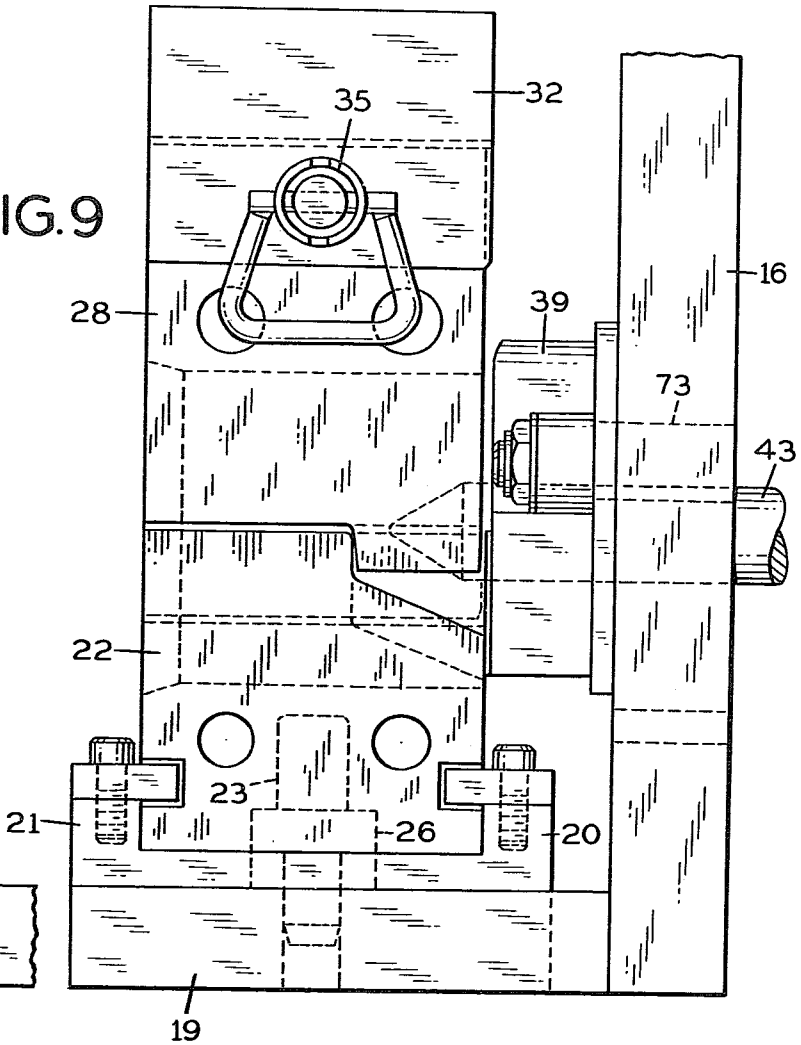
FIGS. 8 and 9 are front and side elevations, respectively, illustrating an advantageous arrangement for mounting of gripping dies in the billet centering machine of the invention.

In the arrangement illustrated in FIGS. 5 and 6, assuming the die blocks are fully open and the ram 41 is fully retracted, the floating slide block 45 is urged to its uppermost limit position by the springs 47, limited by the bolts 48. This position corresponds to the maximum out of tolerance condition in the oversize direction that the equipment will adjust for. Likewise, when the bracket 45 bottoms against the base member 44, the position of the slide bracket corresponds to the maximum out of tolerance condition in the undersize direction that the equipment will accommodate. If the billet is perfectly nominal, the lower surface of the floating bracket 45 will occupy the nominal position indicated in broken lines in FIG. 6.

Assuming that a given billet, inserted between the clamping dies 22, 28, is slightly undersized, the descent of the upper clamping die 28, when the clamping ram 37 is driven downward, will cause the compensating lever 57 to pivot downward. As the dies approach the maximum oversize position, the intermediate cam roll 66 engages the lower extension 68 of the flowing C-shaped bracket 67. Continued downward movement of the clamping ram, as the die 28 approaches the undersized billet, causes the floating bracket 45 to be depressed, carrying with it the punch 43. Pursuant to the stipulated undersized condition, the compensating lever 57 will be brought to a position slightly below the nominal or horizontal position, at which time the undersized billet will be firmly gripped by the die blocks. At this point, the compensating lever 57 will have lowered the axis of the punching tool 43 below the nominal position, by exactly one half the amount by which the billet diameter is undersized relative to nominal diameter.

With the position of the center punch 43 having been automatically compensated for variation from nominal of the billet diameter, the ram 41 is advanced toward and into contact with the clamped end of the billet. As the ram is advanced, the C-shaped bracket 67 advances with respect to the cam wheel 66, so that, at the time that the punch engages the billet, both arms 68, 69 of the bracket embrace the cam roll 66, providing a mechanical interlock of the punching tool 43 in its compensated position. Because the roll contacting surfaces of the bracket arms 68, 69 are parallel to the axis of the ram 41, the vertical compensation of the center punch tool 43 is not affected by the forward-rearward movement of the punching ram 41.

Figure 8:
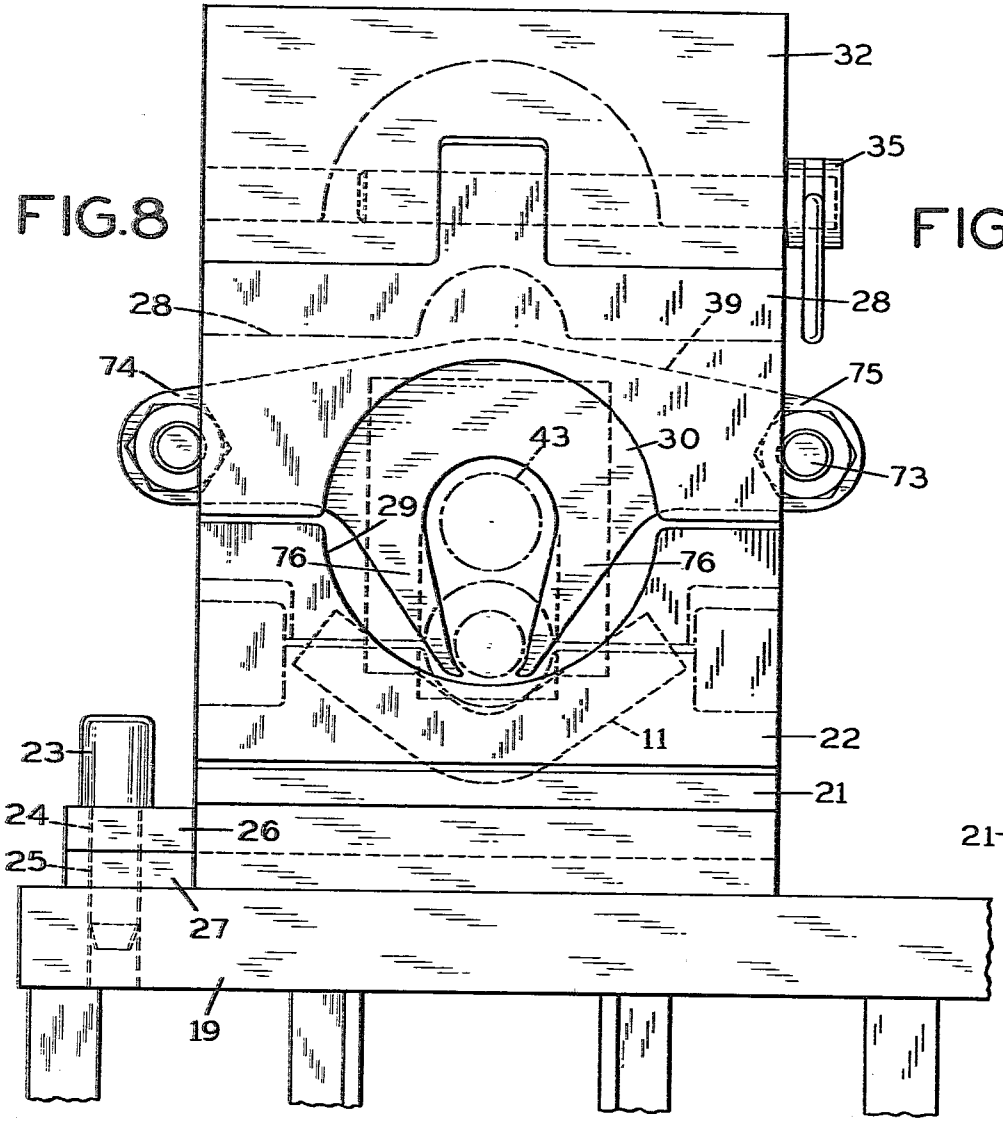

After completion of the center punching operation, the punching ram 41 is retracted and withdrawn, freeing the intermediate cam roll 66 for upward pivoting movement of the compensating lever 57 to the fully opened position of the upper die block 28. The center punched billet is then ejected from the apparatus by means of the pusher plate 39. The pusher plate is actuated by means of a fluid cylinder 70, which is fixed to the machine frame and has its rod 71 connected to a yoke 72. Tie-rods 73 connect the yoke 72 to the pusher plate 39. As is reflected particularly in FIG. 8, the pusher plate 39 includes laterally extending arms 74, 75, which are located in the opening between the lower clamping die 22 and the fully raised upper clamping die 28. The pusher plate includes a pair of billet-engaging fingers 76, which converge in a downward and inward direction, so as to lie within the semi-cylindrical recess of the lower clamping die 22 of any size. In FIG. 8, the largest size of clamping die is illustrated in full lines, whereas the smallest size is illustrated in broken lines.

The billet-engaging fingers 76 between them define a vertically elongated opening, which is arranged to receive the center punching tool 43. In this respect, it is generally desired to utilize a somewhat larger diameter punch for larger diameter billets and a somewhat smaller diameter punch for smaller diameter billets. The punch mounting block 50 provides for removable mounting of the center punch tools, by means of a tapered key 77 or the like, as shown in FIG. 5.

The apparatus of the invention significantly improves the performance of hydraulic center punching of metal billets by providing automatic compensation for the inevitable variations in diameter from billet to billet. This is accomplished in a uniquely effective way by utilizing the motion of a movable clamping die, which automatically reflects the actual size of the billet, to achieve a fine adjustment of the position of the center punch, so the latter is located as closely as practicable to the actual center line axis of the billet. In a typical billet centering system, the various billets, of all sizes, are fed into the centering apparatus on a common feed table, in the form of a trough of fixed height. The equipment thus includes various sets of clamping dies, with the lower die of each set being arranged to receive a billet directly from the common feed table. The upper die is arranged such that, when it is properly closed upon the lower die to clamp a billet of ideal, nominal dimensions, the clamp actuating means will be in a predetermined, common reference position, consistent for all sizes. By mounting the punching tool, and the primary adjustment therefor, on a floating slide block, which is mechanically coupled with the upper clamping die, the nominal adjusted position of the center punching tool is automatically compensated, slightly upward or slightly downward, to adjust for oversize or undersized billets.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In an apparatus for center punching billets, as for the production of seamless tubing, wherein the apparatus includes
(a) means for clamping a billet in position for punching,
(b) a center punching tool,
(c) actuator means for advancing said center punching tool into an end face of a clamped billet,
(d) mounting means for securing said tool for advancing movement by said actuator means, and
(e) primary adjusting means for adjustably positioning said tool in alignment with the nominal axis of a billet of predetermined nominal diameter, the improvement characterized by
(f) compensating means mechanically coupled with said clamping means for adjustably positioning said tool independently of said primary adjusting means, to compensate for variation of the billet from nominal diameter.

2. A center punching apparatus according to claim 1, further characterized by
(a) said actuator means including a longitudinally disposed hydraulic actuator having a movable ram,
(b) a transversely movable floating slide member mounted on said ram,
(c) said primary adjusting means and said punching tool being mounted on said floating slide member for transverse movement relative to and in the same direction as said floating slide member.

3. A center punching apparatus according to claim 1, further characterized by
(a) a fixed height feed table for supporting billets at said apparatus,
(b) a lower clamping die provided with an upwardly opening generally semi-cylindrical jaw arranged to receive the end of a billet supported on said feed table,
(c) an upper clamping die provided with a downwardly opening generally semi-cylindrical jaw arranged at the end of a billet engaged by said lower clamping die,
(d) actuator means for raising and lowering said upper die, and
(e) said compensating means being mechanically coupled with said upper clamping die.

4. A center punching apparatus according to claim 3, further characterized by
(a) said compensating means including a compensating lever pivoted at one end on the machine frame and coupled at its other end to said upper clamping die, and
(b) means connecting said punching tool and said primary adjusting means to said compensating lever.

5. In an apparatus for center punching billets, as for the production of seamless tubing, wherein the apparatus includes
(a) means for clamping a billet in position for punching,
(b) a center punching tool,
(c) actuator means for advancing said center punching tool into an end face of a clamped billet,
(d) means mounting said punching tool for transverse movement in relation to the axis of a clamped billet, and
(e) means coupling said punching tool with means for positioning said tool as a function of the position of the clamping means.

6. A center punching apparatus according to claim 5, further characterized by
(a) means mounting said punching tool on said actuator means for longitudinal movement therewith, and
(b) said coupling means being operative to effect transverse movement of the punching tool relative to said actuator means in response to the position of said clamping means.

7. A center punching apparatus according to claim 6, further characterized by
(a) the mounting means for said punching tool comprising a first slide member mounted on said actuator means,
(b) a second slide member being mounted on said first slide member and carrying said punching tool, and
(c) primary adjusting means connecting said second slide to said first slide.

8. A center punching apparatus according to claim 6, further characterized by
(a) said coupling means comprising a slide member movable longitudinally by said actuator means and transversely by said clamping means,
(b) a compensating lever pivoted at one end and movably coupled with said clamping means at its other end,
(c) said slide member being connected to said compensating lever between its ends.

9. A center punching apparatus according to claim 8, further characterized by
(a) said slide member including a longitudinally disposed reference surface, and
(b) said compensating lever mounting a cam roller or the like operative to engage said reference surface and transversely displace said slide block in various longitudinal positions of said slide block.

10. A center punching apparatus according to claim 9, further characterized by
(a) said reference surface being formed in part by a forwardly opening C-shaped bracket mounted on said slide and operative to embrace said cam roller.

11. In an apparatus for center punching billets, as for the production of seamless tubing, wherein the apparatus includes
(a) means for clamping a billet in position for punching,
(b) a center punching tool,
(c) actuator means for advancing said center punching tool into an end face of a clamped billet,
(d) mounting means for securing said tool for advancing movement by said actuator means,
(e) primary adjusting means for adjustably positioning said tool in alignment with the nominal axis of a billet of predetermined nominal diameter, the improvement characterized by
(f) secondary adjusting means mounting said tool and said primary adjusting means,
(g) said secondary adjusting means being operative to adjustably position said tool independently of said primary adjusting means, and
(h) means for sensing the actual diameter of a clamped billet,
(i) said sensing means being coupled with said secondary adjusting means, whereby the position of said tool is adjusted to compensate for variation of the billet from nominal diameter.

* * * * *